US006510637B2

(12) United States Patent
DeLozada et al.

(10) Patent No.: US 6,510,637 B2
(45) Date of Patent: Jan. 28, 2003

(54) DISPLAY PANEL AND FRAME COMBINATION FORMED OF SHEET MATERIAL

(76) Inventors: Rudy DeLozada, deceased, late of Paris (FR), by Sylvie Hernandez, legal representative; Sylive Hernandez, 1 Rue Pixerecourt - 6B2, Paris 75020 (FR)

( * ) Notice: Subject to any disclaimer, the term of this patent is extended or adjusted under 35 U.S.C. 154(b) by 0 days.

(21) Appl. No.: 09/810,990

(22) Filed: Mar. 15, 2001

(65) Prior Publication Data

US 2002/0129530 A1 Sep. 19, 2002

(51) Int. Cl.[7] ..... A47G 1/06
(52) U.S. Cl. ..... 40/788; 40/786
(58) Field of Search ..... 40/786, 788, 789

(56) References Cited

U.S. PATENT DOCUMENTS

| | | | | | |
|---|---|---|---|---|---|
| 1,331,009 | A | * | 2/1920 | Ford | 40/788 |
| 1,528,361 | A | * | 3/1925 | Bashwiner | 40/788 |
| 3,286,387 | A | * | 11/1966 | Poertner | 40/788 |
| 3,354,560 | A | * | 11/1967 | Kuenzel | 40/788 |

* cited by examiner

*Primary Examiner*—Cassandra H. Davis
(74) *Attorney, Agent, or Firm*—Thomas R. Lampe

(57) ABSTRACT

A flat display panel and a frame for the display panel are formed from a single blank of sheet material such as paperboard. The frame includes a support panel positioned behind the display panel and interconnected frame elements forming a recess accommodating the display panel and projecting outwardly from the display panel.

15 Claims, 4 Drawing Sheets

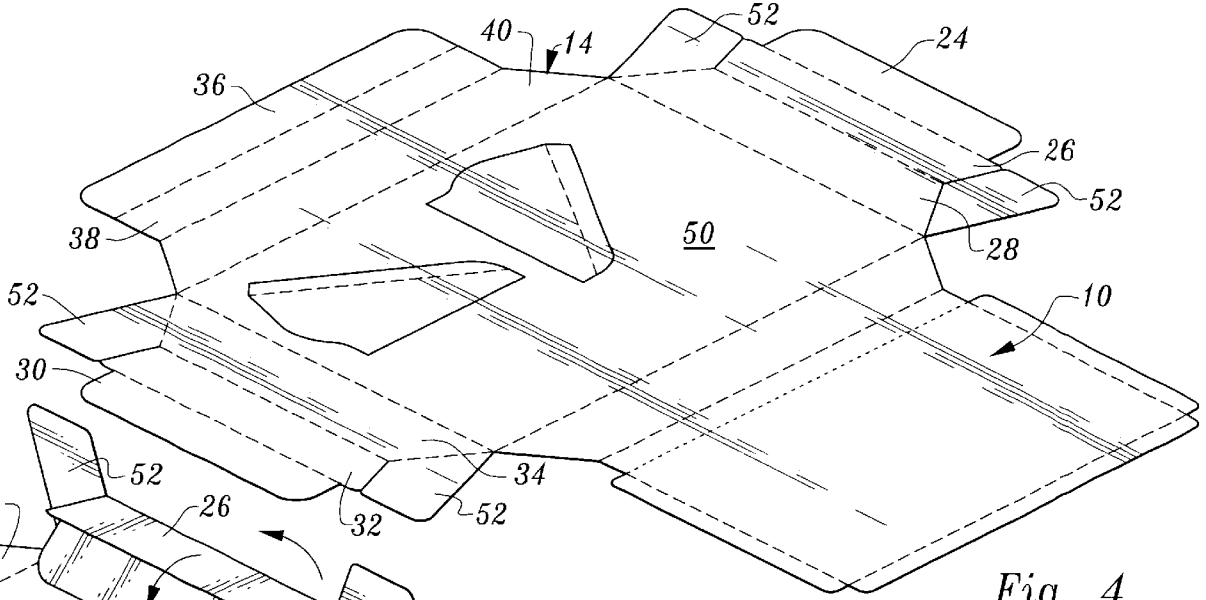
Fig. 4
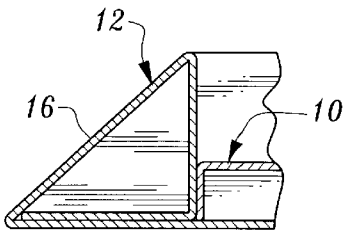
Fig. 8
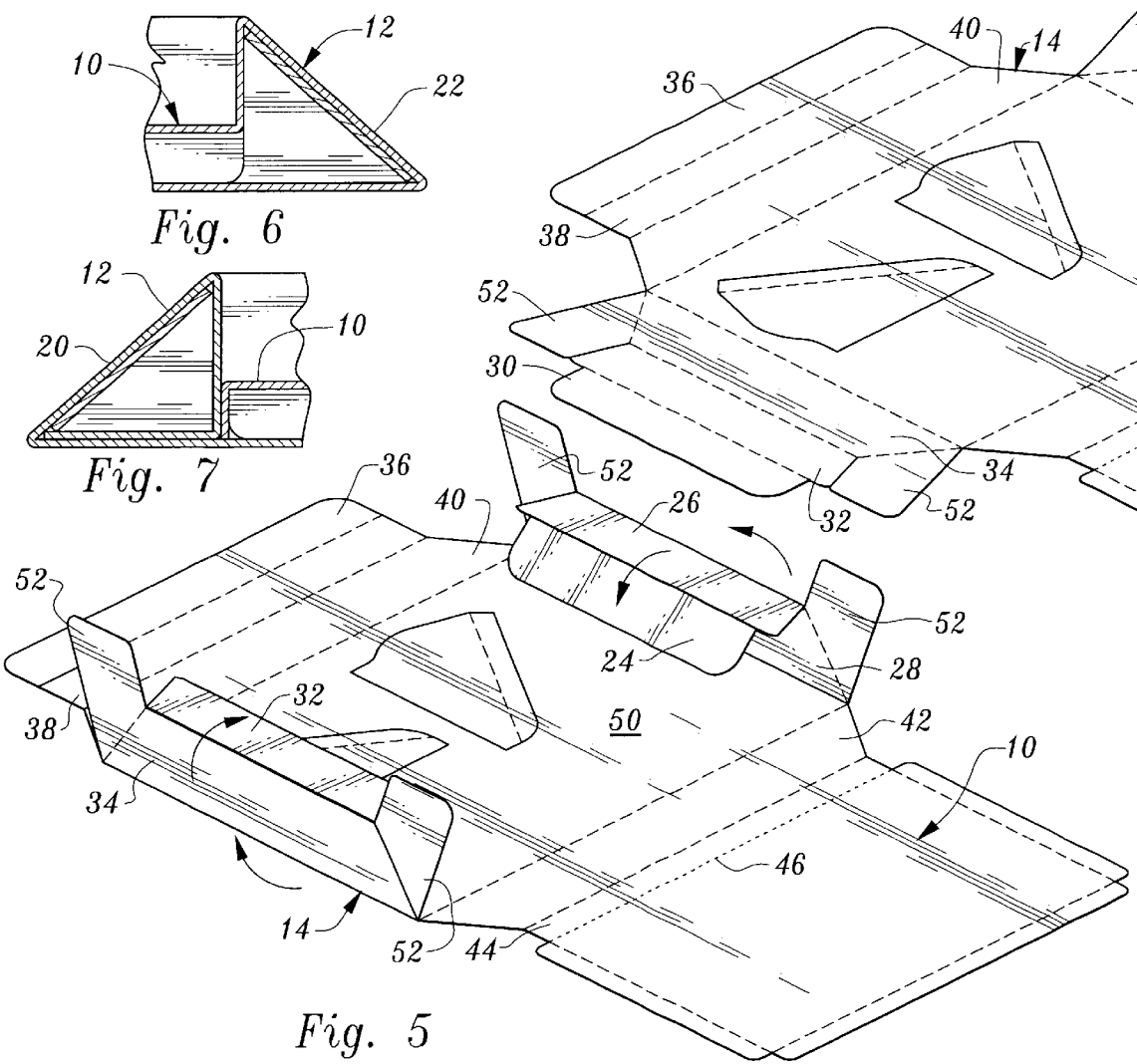
Fig. 5
Fig. 6
Fig. 7

DISPLAY PANEL AND FRAME COMBINATION FORMED OF SHEET MATERIAL

TECHNICAL FIELD

This invention relates to a combination display panel and frame formed from a single blank of sheet material such as paperboard. The invention is suitable, for example, for displaying a graphic reproduction of a painting in a frame simulating a wooden frame.

BACKGROUND OF THE INVENTION

It is well known to provide painting reproductions and to sell such reproductions with or without conventional frames. Conventional frames, of course, are bulky and can be quite expensive. As a consequence, sales of combined reproductions and frames are of relatively low volume. For example, gift stores associated with art galleries and museums sell prints and frames but such combinations do not meet with widespread acceptance by the casual tourist for economic or other reasons such as bulk.

It is therefore desirable to provide an inexpensive and compact alternative, an objective met by the invention disclosed and claimed herein.

DISCLOSURE OF INVENTION

The present invention provides a low cost alternative to the standard combination of a print and frame. The combination of the present invention is of simple construction, being suitably formed from a single blank of sheet material such as paperboard. The combination may be displayed for sale, stored or transported in a flat condition. This is advantageous not only to the vendor from the standpoint of conserving storage and display space but also to the purchaser who can maintain the combined frame and display panel in a flattened state until use is desired, at which point the structural elements of the combination may be quickly manipulated to construct the final and complete assembly for display purposes.

The combination of the present invention includes a flat display panel formed of sheet material having a front surface imprinted with a pictorial display and a back surface.

The combination also includes a frame formed of sheet material surrounding the display panel and hingedly connected thereto. The frame includes a plurality of interconnected frame elements defining a recess accommodating the display panel and projecting outwardly from the display panel front surface.

Each of the frame elements is comprised of a plurality of interconnected frame element panels, the display panel and the frame being formed from a unitary blank of sheet material, such as paperboard.

Other features, advantages, and objects of the present invention will become apparent with reference to the following description and accompanying drawings.

BRIEF DESCRIPTION OF DRAWINGS

FIG. 4 is a perspective view of the blank at an early stage of display panel and frame assembly formation;

FIG. 5 is a view similar to FIG. 4, but illustrating a subsequent stage;

FIG. 6 is an enlarged, sectional view taken along the line 6—6 of FIG. 1;

FIG. 7 is an enlarged, perspective view taken along the line 7—7 of FIG. 1;

FIG. 8 is an enlarged, cross-sectional view taken along the line 8—8 of FIG. 1;

BEST MODE FOR CARRYING OUT THE INVENTION

Figure 1:
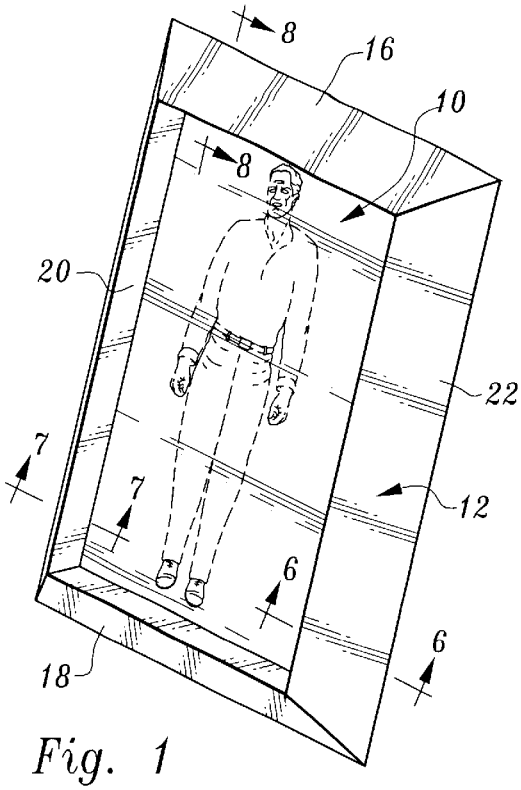
FIG. 1 illustrates a preferred embodiment of the invention in assembled form and including a display panel and frame being maintained in a generally vertical condition.

Referring now to the drawings, a completed assembly constructed in accordance with the teachings of the present invention includes a display panel 10 and a frame 12, the display panel and frame being formed from a single blank of 14 of sheet material such as paperboard. The front surface of the display panel 10 is imprinted with a pictorial display, in this instance a full figure depiction of a man. The frame itself may also be printed to provide the appearance of an actual wood frame.

In assembled condition, the frame 12 surrounds the display panel 10, the display panel and the frame being hingedly connected.

The frame 12 includes a plurality of interconnected frame elements defining a recess accommodating the display panel 10 and projecting outwardly from the display panel front surface. Each of the frame elements is comprised of a plurality of interconnected frame element panels.

More particularly, the frame elements include a frame top 16, a frame bottom 18 and a pair of frame sides 20, 22.

Frame top 16 comprises a plurality of interconnected top panels 24, 26, 28 interconnected along top panel fold lines. Frame bottom 18 is comprised of the plurality of bottom panels 30, 32, 34 interconnected along bottom panel fold lines. Frame side 20 includes a plurality of side panels 36, 38 and 40 interconnected along side panel fold lines. And frame side 22 is comprised of a plurality of interconnected side panels 42, 44 interconnected along side panel fold lines.

Display panel 10 is connected to side panel 44 along a line of weakness or tear line 46. This enables the display panel to be torn from the frame 12 and utilized separately if desired. For example, the display panel 10 could be sized and the back printed in the format of a postcard and employed for such purpose.

The frame top, frame bottom and frame sides are connected along fold lines to a rectangular-shaped support panel 50.

FIGS. 4, 5 and 9–12 show sequential operations being carried out when forming the blank 14 into the assembly shown in FIG. 1. As can be seen with reference to FIGS. 4 and 5, the first stage of assembly of the illustrated embodiment includes bending of the top and bottom panels as shown by the arrows in FIG. 5.

It should be noted that lock tabs 52 are hingedly connected to the ends of top panel 28 and bottom panel 34.

Figure 9:
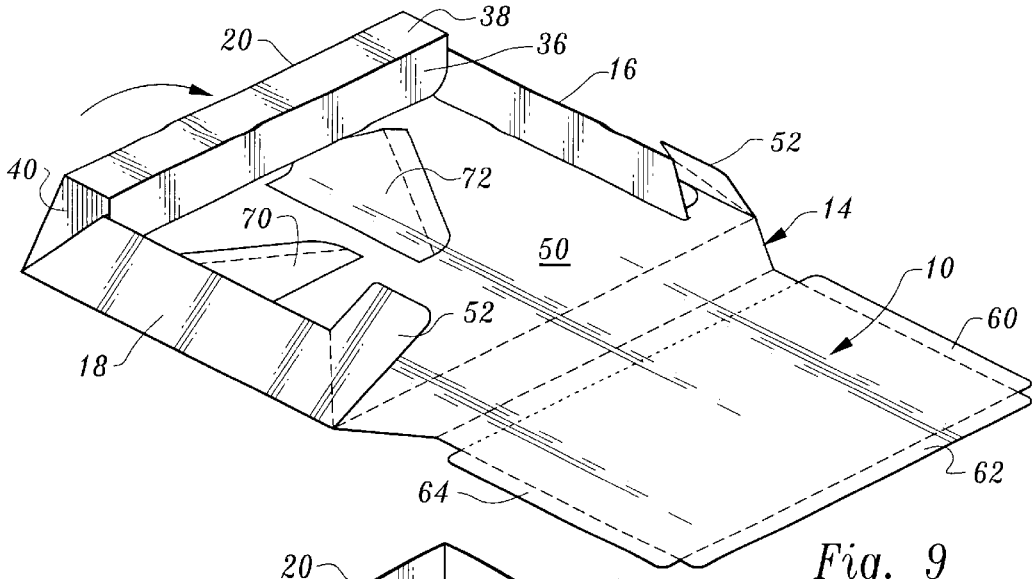
FIGS. 9–12 illustrate sequential stages in the formation of the display panel and frame assembly.
Figure 10:
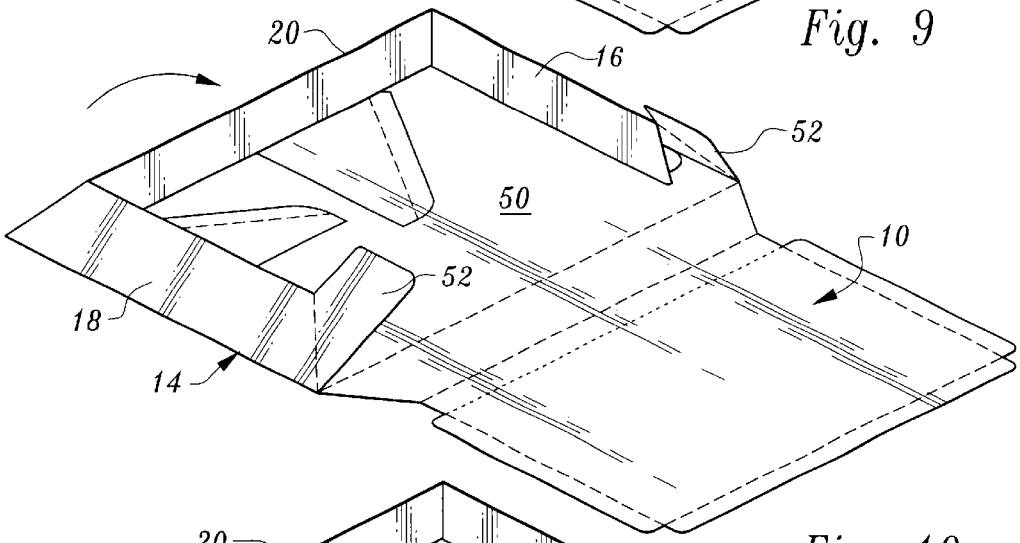

Referring now to FIG. 9, the side panels 36, 38 and 40 are shown in the process of being folded into place, the ends of the completed side panel 20 encompassing lock tabs 52 projecting from ends of top panel 28 and bottom panel 34, those lock tabs 52 being locked in place when the frame side 28 is fully assembled as shown in FIG. 10.

Figure 11:
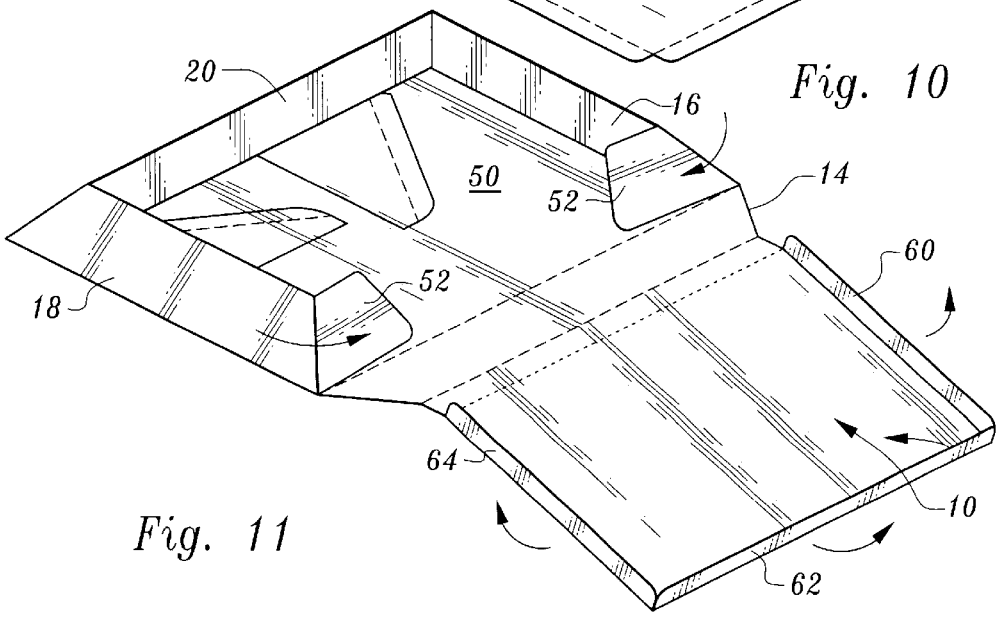
Figure 12:
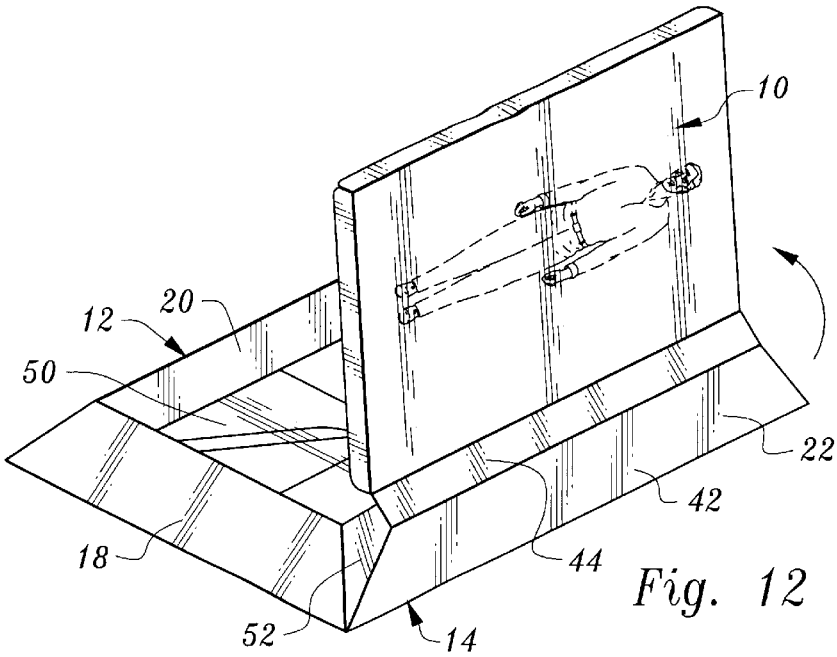

Next, spacer panels 60, 62 and 64 attached to three sides of display panel 10 are folded as shown by the arrows in FIG. 11. Then side panels 42, 44 are folded relative to one another and to the display panel 10 as shown in FIG. 12, the lock tabs 52 at that side of the frame being captured therebetween when the display panel 10 is positioned in the recess defined by the frame top, frame bottom and frame sides as shown in FIG. 1.

The spacer panels 60, 62, 64 will maintain spacing between the inside or back surface of the display panel and support panel 50. It will be appreciated that the display panel 10 is sized to provide a friction fit between the frame top, frame bottom and frame sides.

Figure 2:
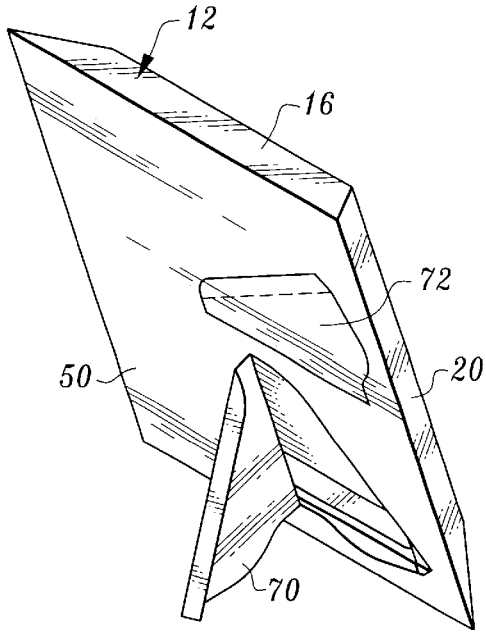
FIG. 2 is a perspective view taken from the back.
Figure 3:
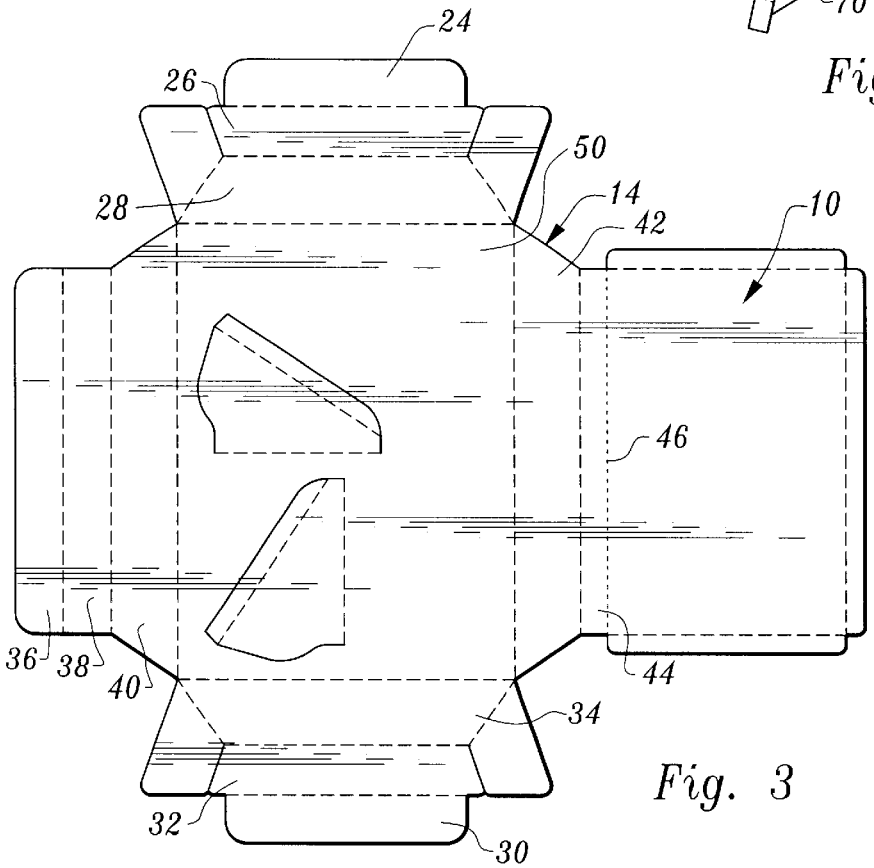
FIG. 3 illustrates a blank of paperboard material in flattened condition, the blank utilized to form the assembly of FIG. 1.
Figure 13:
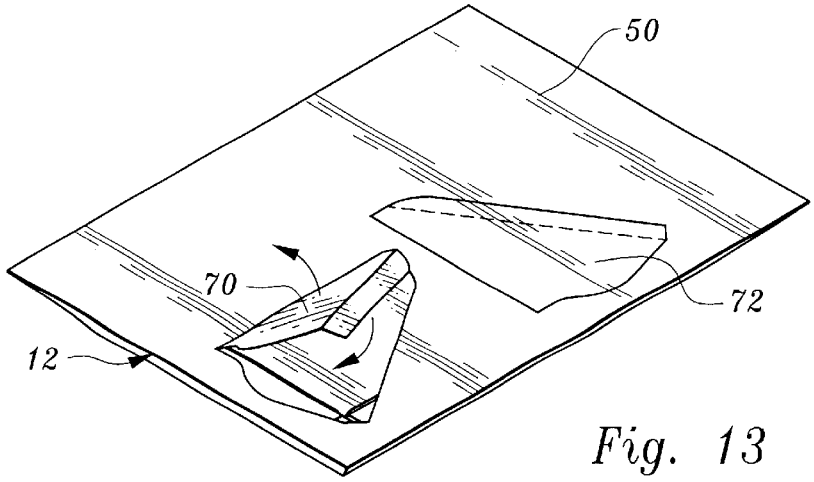
FIG. 13 is a perspective view of the assembled frame and display panel and illustrating a support tab being formed to support the assembly.

Support tabs 70, 72 are formed in support panel 50. The support tabs are spaced from one another and oriented ninety degrees with respect to one another. Either of the support tabs may be utilized to support the frame and display panel in an elevated or generally vertical condition for display purposes. FIG. 13 shows support tab 70 being positioned to provide such support and FIG. 2 shows the support tab 70 actually providing such support.

Figure 14:
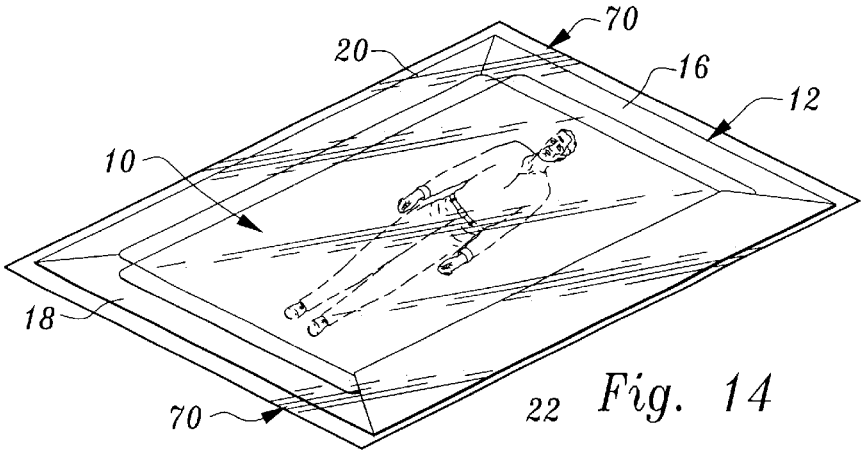
FIG. 14 illustrates a package comprising the disclosed embodiment in flat condition covered by a transparent wrap.

FIG. 14 illustrates a package comprising the elements of the assembly in flattened condition and covered by a transparent overwrap, plastic or cellophane, for example. In this configuration, the panels of the top, bottom and sides and the display panel are folded over the support panel. The package is compact for storage, display and shipping.

The invention claimed is:

1. In combination:

a flat display panel formed of sheet material having a front surface imprinted with a pictorial display and a back surface; and a frame formed of sheet material surrounding said display panel and hingedly connected thereto, said frame including a plurality of frame elements defining a recess accommodating said display panel and projecting outwardly from said display panel front surface, each of said frame elements being comprised of a plurality of interconnected frame element panels, said display panel and said frame being formed from a unitary blank of sheet material, said frame additionally including a support panel behind said display panel.

2. The combination according to claim 1 wherein said frame elements are interconnected to edges of said support panel along fold lines.

3. The combination according to claim 2 wherein said frame elements include a frame top comprised of a plurality of interconnected top panels, a frame bottom comprised of a plurality of bottom panels and a pair of frame sides each comprised of a plurality of interconnected side panels.

4. The combination according to claim 3 wherein said top panels are interconnected along top panel fold lines, said bottom panels are interconnected along bottom panel fold lines and said side panels are interconnected along side panel fold lines.

5. The combination according to claim 1 wherein said flat display panel is hingedly connected to said frame along a line of weakness facilitating manual removal of said display panel from said frame by tearing along said line of weakness.

6. The combination according to claim 1 including lock means releasably locking said frame elements end to end.

7. The combination according to claim 6 wherein said lock means includes lock tabs extending from ends of at least some of said frame elements in frictional engagement with adjacent frame elements.

8. The combination according to claim 7 wherein said lock tabs are located at corners of said frame.

9. The combination according to claim 8 additionally comprising spacer panels foldably connected to said display panel and extending rearwardly therefrom to engage said support panel.

10. The combination according to claim 1 additionally comprising at least one support tab formed in said support panel for positioning behind said support panel in engagement with a support surface to maintain said frame and display panel in a generally vertical orientation.

11. The combination according to claim 10 wherein a plurality of said support tabs are formed in said support panel, said support tabs being spaced from one another and disposed at different orientations to allow support of said frame and support panel in a plurality of generally vertical orientations.

12. The combination according to claim 1 wherein the sheet material of said frame and of said display panel is paperboard.

13. A unitary blank of sheet material including a flat display panel having a front surface imprinted with a pictorial display and a frame including a plurality of frame elements hingedly connected to said display panel, each of said frame elements being comprised of a plurality of interconnected frame element panels, said frame element panels of each of said frame elements being interconnected along fold lines to facilitate formation of the frame defining a recess accommodating said display panel with said frame elements projecting outwardly from the display panel front surface, said frame additionally comprising a support panel, and said frame elements being hingedly connected to said support panel along fold lines.

14. In combination:

a flat display panel formed of sheet material having a front surface imprinted with a pictorial display and a back surface; and a frame formed of sheet material surrounding said display panel and hingedly connected thereto, said frame including a plurality of frame elements defining a recess accommodating said display panel and projecting outwardly from said display panel front surface, each of said frame elements being comprised of a plurality of interconnected frame element panels, said display panel and said frame being formed from a unitary blank of sheet material, said flat display panel being hingedly connected to said frame along a line of weakness facilitating manual removal of said display panel from said frame by tearing along said line of weakness

15. In combination:

a flat display panel formed of sheet material having a front surface imprinted with a pictorial display and a back surface;

a frame formed of sheet material surrounding said display panel and hingedly connected thereto, said frame including a plurality of frame elements defining a recess accommodating said display panel and projecting outwardly from said display panel front surface, each of said frame elements being comprised of a plurality of interconnected frame element panels, said display panel and said frame being formed from a unitary blank of sheet material;

lock means releasably locking said frame elements end to end, said lock means including lock tabs extending from ends of at least some of said frame elements in frictional engagement with adjacent frame elements and located at corners of said frame; and spacer panels foldably connected to said display panel and extending rearwardly therefrom to engage said support panel.

* * * * *